United States Patent [19]

Carbone et al.

[11] Patent Number: 4,822,980

[45] Date of Patent: Apr. 18, 1989

[54] PTC HEATER DEVICE

[75] Inventors: Douglas C. Carbone, Standish; Lee A. Prager, Raymond, both of Me.

[73] Assignee: GTE Products Corporation, Stamford, Conn.

[21] Appl. No.: 45,114

[22] Filed: May 4, 1987

[51] Int. Cl.[4] ..... H05B 1/02; H05B 3/00; H05B 3/82; H01C 7/02

[52] U.S. Cl. ..... 219/315; 219/205; 219/316; 219/335; 219/338; 219/505; 219/530; 219/534; 219/540; 219/544; 338/22 R

[58] Field of Search ..... 219/222, 225, 230, 530, 219/540, 336, 338, 335, 523, 504, 505, 534, 544, 316, 315, 205; 338/22 R, 225 D, 25, 28

[56] References Cited

U.S. PATENT DOCUMENTS

| | | | |
|---|---|---|---|
| 3,564,199 | 2/1971 | Blaha | 219/338 U X |
| 3,673,382 | 6/1972 | Gaffney et al. | 219/534 X |
| 3,996,447 | 12/1976 | Bouffard et al. | 219/544 X |
| 4,104,509 | 8/1978 | Van Bokestal et al. | 338/22 R |
| 4,147,927 | 4/1979 | Pirotte | 219/534 X |
| 4,352,008 | 9/1982 | Hofer et al. | 219/540 |
| 4,680,444 | 7/1987 | Skuvdal et al. | 219/222 |
| 4,689,878 | 9/1987 | Beauregard et al. | 338/22 R |

FOREIGN PATENT DOCUMENTS

| | | | |
|---|---|---|---|
| 2822327 | 12/1978 | Fed. Rep. of Germany | 219/222 |
| 54-12960 | 1/1979 | Japan | 219/505 |
| 731318 | 4/1980 | U.S.S.R. | 338/22 R |
| 2084437 | 4/1982 | United Kingdom | 219/523 |

*Primary Examiner*—Anthony Bartis
*Attorney, Agent, or Firm*—James Theodosopoulos

[57] ABSTRACT

A heating device adapted to be disposed in an opening in the side wall of a compressor that is used with an air conditioner or refrigerator so that fluids in the casing of the compressor can be vaporized. The heating device includes a PTC thermistor disposed in a housing and a generally cylindrical receptacle disposed about the housing. The housing includes at least one outwardly extending, resilient, heat dissipating, arcuate fin overlying the outer surface of the housing in spaced relation thereto. The fin is biased outwardly to engage the inner walls of a receptacle. The receptacle is welded into the opening in the sidewall of the casing of the compressor. The fins form a snug fit with the housing and provide a good heat transfer contact with the receptacle. Lead-in wires extend from the PTC thermistor to the outside of the housing so that the PTC thermistor can be connected to a power supply.

12 Claims, 2 Drawing Sheets

PTC HEATER DEVICE

FIELD OF THE INVENTION

The present invention relates to self-regulating heaters, and particularly to a heater utilizing positive temperature coefficient (PTC) thermistors, that can be used in refrigeration and air conditioner compressors to separate the various fluid components that are used in such units by their different boiling points.

BACKGROUND OF THE INVENTION

PTC thermistors are commonly used in conjunction with refrigeration and air-conditioner compressors. These thermistors serve to separate, by fractional distillation, lubricating oil and compressor fluid in the crank case of the compressor. To accomplish such separation, it is necessary to insure that an efficient thermal relationship is established between the PTC thermistor and the receptacle in which it is housed. Several approaches have been devised to accomplsih an efficient heat exchange relationship. For example, compressor manufacturers have applied silicone sealing grease around the PTC during installation, whereby the PTC thermistor will conduct heat directly to the casing of the compressor. It is also known to mold the PTC thermistor in a thermally conductive silicone rubber, and when the heater is energized in the casing, the rubber will expand to provide a tight fit. Each of these approaches is somewhat messy and not overly efficient in heat transfer.

PTC thermistors are especially useful in situations in which there is a need for a heater that regulates its own temperature. When electrical current is directed through the PTC thermistor, it tends to heat and display increasing resistivity during heating so that current in the thermistor is reduced whereby its rate of heat generation is decreased. With PTC thermistors, when the rate of heat generation reaches equilibrium with the rate of the heat dissipation, the thermistor's temperature stabilizes and limits the resistor current to a predetermined level. The initial room temperature resistivity of a PTC material and the rate of change of resistivity with temperature are characteristic of the material, and the materials used in such thermistors are commonly chosen to display a sharp anomalous increase in resistivity at a particular temperature, thereby to stabilize heating of the thermistor at about that temperature while also reducing resistor current to a very low level at the stabilizing temperature.

PTC thermistors have been in use for many years and heaters utilizing such thermistors offer several operating advantages over conventional resistance heating elements in the heating of various fluids. They can be made in a flat shape, formed generally of a doped barium titinate ceramic which has a sharp positive temperature coefficient of resistance. The PTC thermistor are designed such that below the critical or anomaly temperature, the resistance of the ceramic that forms them remains at a low value and is essentially constant. When a particular temperature is reached, a crystalline phase change takes place in the ceramic and this change in the ceramic structure is accompanied by a sharp increase in the resistance at the crystalline grain boundaries. With the unique temperature characteristics of the PTCs, they are extremely valuable in providing heat at precise temperatures whereby to vaporize certain fluids and not vaporize others, thereby effectively separating the fluids into their components. The temperature at which the crystalline change takes place can be adjusted in the PTC thermistor manufacturing process through the use of appropriate chemical dopents and can be varied between about −50° C. and 300° C. When energized with a suitable current by applying voltage to the opposite sides of the device, the PTC thermistor rapidly heats up to a predetermined operating temperature and then "locks in" at that temperature. This rapid heating is due to the initial low resistance of the PTC ceramic which results in an internal high power of the heater. The lock-in is due to the abrupt increase in the resistance which causes generated power to reduce until it equals dissipated power. At this point, thermal equilibrium is achieved and the PTC thermistor self-regulates itself at that temperature, and when used with compressors or air conditioners to separate fluids into fractions, only the compressor fluid will be vaporized, while leaving the lubricating oil in a liquid state. The high rate of heat transfer is accomplished by the specific construction of the heater of the present invention which enables heat to be readily transferred from the PTC thermistor to the fluids in the vessel in which the heating device is housed.

SUMMARY OF THE INVENTION

According to the present invention, we have discovered a heating device that is adapted to be disposed in a receptacle that is fitted in an opening in the side wall of a vessel. The heating device includes a PTC thermistor and a housing disposed about the PTC thermistor. The PTC thermistor is held in an electrically insulating, heat-transmitting potting material that is disposed inside of the housing and about the PTC, whereby to provide for electrical insulation and thermal conductivity. The housing of the present invention includes a body with at least one heat dissipating arcuate fin that extends from the outer side thereof. The arcuate fin is sprung outwardly from a juncture where it connects with the body whereby it will urge against the inside of the receptacle in which the housing is seated. Preferably, the heating device is formed of a body with two arcuately disposed fin members that each extend from the body and the ends of the fins each being biased outwardly. More preferably, the two junctures between the body and the fins are diagonally opposed to each other so that spring tension produced by the fins will be equally distributed, whereby to keep the body in place in the receptacle.

The housing has a generally cylindrical shape with an internal cavity formed therein. The PTC thermistor is disposed in the cavity and the heat-transmitting, electrically insulating potting material is disposed between the PTC heater and the body of the heating device. The arcuate fins are defined by two undercuts in the housing that extend along its length, parallel to each other and parallel to its axis. The assembly as described is fitted snugly into the receptacle and can be forced into an aperture in the casing of the compressor of the air conditioner or refrigerator.

DESCRIPTION OF THE PREFERRED EMBODIMENT

Figure 1:
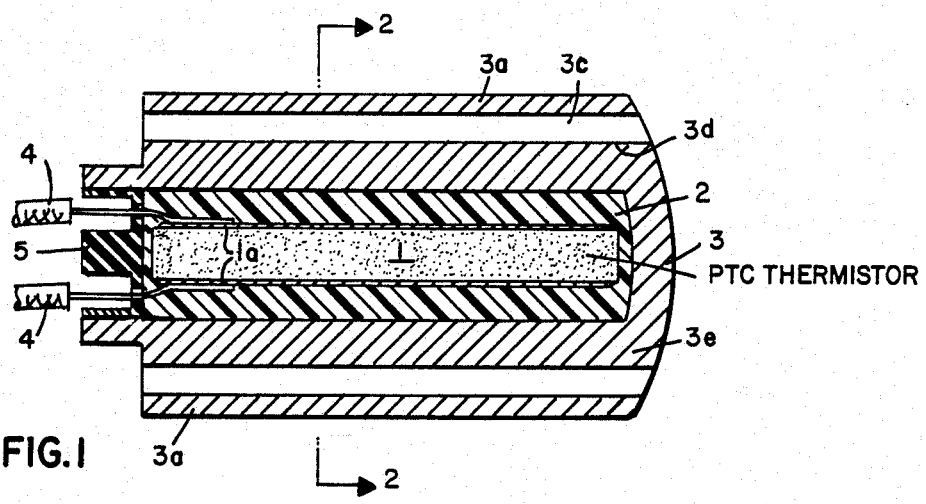
FIG. 1 is a cross-sectional, side elevational view in taken along the line 1—1 of FIG. 2.
Figure 2:
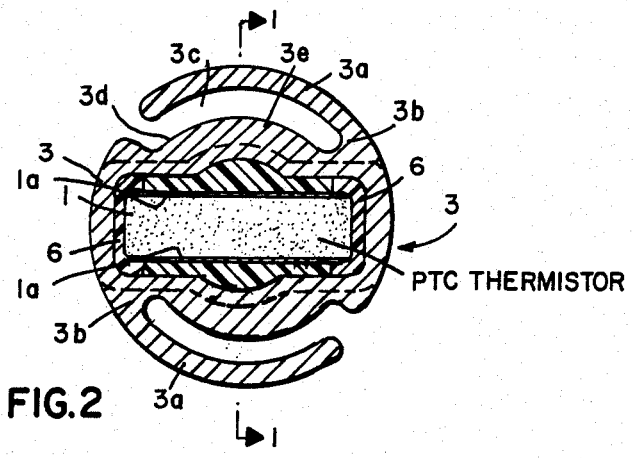
FIG. 2 is a cross-sectional view of the device shown in FIG. 1 taken along the line 2—2 of FIG. 1.

Referring now to FIGS. 1 and 2, the PTC thermistor 1 is provided with electrical power through leads 4 that are ultrasonically welded to an aluminum electrode layer 1*a*. The PTC thermistor and lead assembly is disposed in a cavity 3*d* formed in the body 3*e* of an aluminum housing 3 and potted in a magnesium oxide filled-silicone rubber 2. The silicone rubber, filled with 70 to 90 weight percent magnesium oxide, provides an electrically insulating, thermally conductive path from the PTC thermistor to the aluminum housing 3. A pair of spring clips 6, formed of an electrically insulating material, is used to position the PTC thermistor 1 and insure against its electrical contact with the body 3*e* of the housing 3. A cap 5 is disposed in the cavity 3*d* to provide a closure to the heater and support for the lead wires 4.

As can be seen in FIG. 2, two arcuate fins 3*a* extend outwardly from the body from junctures 3*b* and are formed by undercuts 3*c* that extend along the length of the body and are disposed parallel to its axis. The radius of the fins 3*a* increases from each of the junctures 3*b* to the ends whereby the ends extend radially outwardly from the body 3*e* of the housing 3. This construction enables the user to squeeze the fins 3*a* and snugly insert the heater into a receptacle (not shown in this Figure) fitted into an aperture in the sidewall of a vessel. Thus the heater can be readily removed, as necessary. Thermal intimacy is provided with the heater of the present invention without the use of retainer clips or silicone sealants to hold the heater in the vessel in which it is disposed.

Figure 3:
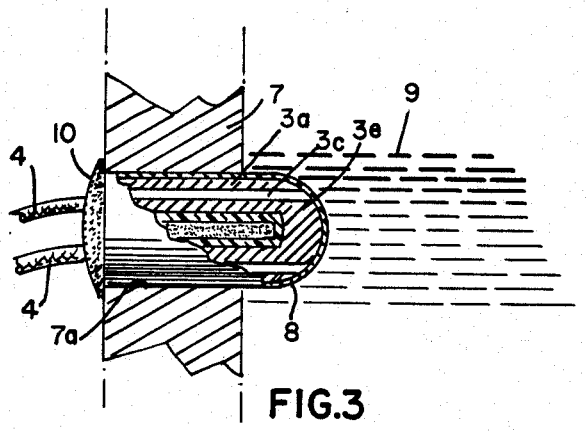
FIG. 3 is an elevational view, partially in cross section, showing the disposition of the PTC heating device according to the present invention in an aperture in the side wall of a compressor, whereby to heat fluids contained therein.

As can be seen in FIG. 3, the heater is disposed in an elongated aperture 7*a* in the side wall of a vessel 7. The fluid 9 contained in the vessel 7 can be heated through thermal transmission of heat from the PTC thermistor disposed in the housing 3 through the receptacle 8 to the side wall 7 of the vessel in which it is disposed. A cap 10 can be disposed over the outer end of the receptacle 8 to give it a finished appearance and provide additional support for the receptacle.

Figure 4:
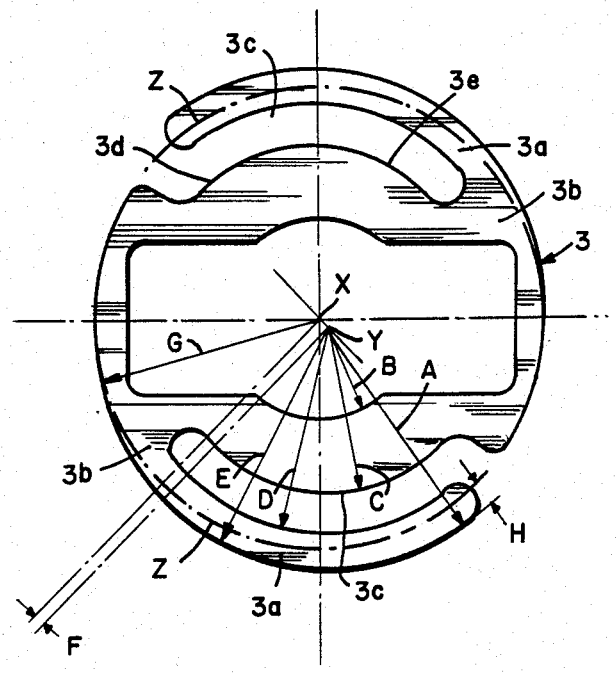
FIG. 4 is an enlargement of FIG. 2 showing a preferred embodiment of the device.

In the preferred embodiment of the invention, the PTC heater assembly is formed from extruded aluminum in a generally cylindrical shape with arcuate fins 3*a* also being part of the general cylindrical configuration. The fins 3*a* urge against the inner walls of the receptacle whereby a snug fit is formed. Referring to FIG. 4, the distance between axis Y and the furthest extremity at the free end of fin 3*a* on radius A is 0.02 inch. The length of radii B, C and D is 0.17, 0.27 and 0.343 inch, respectively. Radius E is 0.392 inch long. Axis Y is offset from a central longitudinal axis X by a distance F. A radius G has an outer circumference depicted by Z. Because of the offset F between the central axis X and axis Y, the fins (at radius A) have at their free ends a distance H larger than the radius G if the housing 3 were a true cylinder. The greater radius A together with the resilient nature of fins 3*a* provide a snug fit into receptacle 8 (shown in FIG. 3) and provide good heat transfer contact between the fins 3*a* and the receptacle 8. Thus, the radius of the housing can increase by about 5 to 15% from the juncture 3*b* between the body 3*e* and the free end of the fin 3*a*.

It is apparent that modifications and changes can be made within the spirit and scope of the present invention but it is our intention, however, only to be limited by the scope of the appended claims.

As our invention, we claim.

1. A heating device adapted to be disposed in an elongated opening in a side wall of a vessel containing fluids to be heated, said device including:

a PTC thermistor having a pair of opposite sides and an elongated thermally conductive housing disposed about said PTC thermistor, said housing being adapted to conduct heat to said vessel from said PTC thermistor and further being adapted to be disposed inside of a receptacle;

means to conduct heat from said housing, said means including at least one arcuate, resilient, heat-dissipating elongated fin extending from a juncture on an outer side of said housing and extending lengthwise of the housing and overlying the outer surface thereof in spaced relation thereto, whereby to engage walls of the receptacle; and means extending into said housing to conduct current to opposite sides of said PTC thermistor.

2. The heating device according to claim 1 wherein there are two of said arcuate fins extending from said housing, each of said fins being biased outwardly from said housing.

3. The heating device according to claim 2 wherein the juncture between each of the fins and the housing are diagonally opposite each other whereby the two fins are adapted to urge against the inner surface of the receptacle and hold the housing in place.

4. The heating device according to claim 2 wherein the fins and the housing cooperate to form a generally cylindrical shape, the fins diverging radially outwardly from the juncture between the housing and the fins.

5. A heating device comprising:

an elongated housing and an internal cavity having inner walls formed in said housing;

a PTC thermistor disposed in said cavity and a heat-transmitting, electrically insulating means disposed in said cavity between the inner walls of said cavity and said PTC thermistor whereby heat can be conducted from said PTC thermistor to said housing; and an under-cut channel disposed parallel to the longitudinal axis of said housing whereby to form an arcuate resilient fin extending from the outer surface of said housing, said fin overlying the outer surface of said housing in spaced relationship thereto and the free end of said fin being biased radially outwardly whereby to enable said heating device to engage a receptacle into which said housing is adapted to be disposed.

6. The heating device according to claim 5 wherein the means to conduct heat is a potting material of silicone rubber and an inert inorganic filler.

7. The heating device according to claim 5 wherein there are two such under-cut channels formed in said body whereby to form two arcuate fins, said fins extending outwardly from said body on an increasing radius.

8. The heating device according to claim 5 wherein lead-in wires extend from said PTC thermistor to the outside of said housing; and an electrically insulating cap disposed in said cavity whereby to seal said PTC thermistor.

9. The heating device according to claim 5 wherein there are two such under-cut channels disposed on said housing whereby to form two such arcuate fins, said fins extending outwardly from said housing on an increasing radius.

10. A heating device comprising:

an elongated receptacle;

an elongated housing formed of thermally conductive material and an internal cavity having inner walls formed on said housing, said housing being disposed in said receptacle;

a PTC thermistor disposed in said cavity between inner walls of said cavity;

a heat transmitting, electrically insulating means disposed in said cavity adjacent said PTC thermistor, whereby heat can be conducted from said PTC thermistor to said housing; and an undercut channel disposed parallel to the longitudinal axis of said housing whereby to form an arcuate resilient fin extending from the outer surface of said housing and overlying the outer surface, said fin being biased radially outwardly into contact with the inner surfaces of said receptacle in spaced relation thereto.

11. The heating device according to claim 10 wherein lead-in wires extend from said PTC thermistor to the outside of said housing and an electrically insulating cap disposed in said cavity whereby to seal said PTC thermistor in said cavity.

12. A heating device adapted to be disposed in an elongated opening in a side wall of a vessel containing fluids to be heated, said device including:

a PTC thermistor having a pair of opposite sides;

an elongated thermally conductive housing disposed about said PTC thermistor;

an elongated receptacle adapted to be inserted into an opening in the side wall of a vessel, said housing being disposed in said receptacle and including means for establishing intimate thermal contact between said receptacle and said housing, said means including at least one arcuate, resilient, heat dissipating elongated fin extending from a juncture with the outer surface of said housing, said arcuate fin extending lengthwise of the housing and overlying the outer surface thereof in spaced relation thereto and engaging the walls of said receptacle; and means extending into said housing to conduct current to opposite sides of said PTC thermistor.

* * * * *